US006874544B2

(12) United States Patent
O'Connor et al.

(10) Patent No.: US 6,874,544 B2
(45) Date of Patent: Apr. 5, 2005

(54) SYSTEM FOR DISPENSING MULTI-COMPONENT PRODUCTS

(75) Inventors: William T. O'Connor, Londonderry, NH (US); Robert G. Petit, Grafton, MA (US); M. Scott Curry, Woburn, MA (US)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 10/858,439

(22) Filed: Jun. 1, 2004

(65) Prior Publication Data

US 2004/0216802 A1 Nov. 4, 2004

Related U.S. Application Data

(60) Division of application No. 10/283,033, filed on Oct. 29, 2002, now Pat. No. 6,789,702, which is a continuation of application No. PCT/US01/15912, filed on May 17, 2001, which is a continuation-in-part of application No. 09/574,312, filed on May 19, 2000, now abandoned.

(51) Int. Cl.[7] ..... B65B 1/04

(52) U.S. Cl. ..... 141/3; 141/5; 141/7; 141/10; 141/20; 141/104; 141/114; 141/314; 141/316; 53/470

(58) Field of Search ..... 141/2–10, 18, 141/20, 59, 65, 100, 104, 114, 314–316; 53/467–470, 484, 485

(56) References Cited

U.S. PATENT DOCUMENTS

| | | | | |
|---|---|---|---|---|
| 3,241,722 A | | 3/1966 | Nissen | |
| 3,318,488 A | | 5/1967 | Barnes | |
| 3,335,913 A | | 8/1967 | Bouet | |
| 3,421,661 A | | 1/1969 | Price | |
| 3,451,596 A | | 6/1969 | Marand | |
| 3,454,198 A | * | 7/1969 | Flynn | 222/145.6 |
| 3,455,489 A | | 7/1969 | Meshberg | |
| 3,685,695 A | | 8/1972 | Yuhas | |
| 3,721,371 A | | 3/1973 | Doiveck | |
| 3,731,854 A | | 5/1973 | Casey | |
| 3,791,557 A | | 2/1974 | Venus, Jr. | |
| 3,813,011 A | | 5/1974 | Harrison et al. | |
| 3,823,849 A | * | 7/1974 | Ruscitti | 222/96 |
| 3,825,159 A | | 7/1974 | Laauwe | |
| 3,838,796 A | | 10/1974 | Cohen | |
| 3,873,003 A | | 3/1975 | Seiferth et al. | |
| 3,876,115 A | | 4/1975 | Venus, Jr. et al. | |

(Continued)

FOREIGN PATENT DOCUMENTS

| | | |
|---|---|---|
| DE | 1 632 037 | 11/1970 |
| DE | 42 13 350 | 10/1983 |
| DE | 38 32 938 | 3/1990 |
| EP | 0 757 959 | 2/1997 |
| WO | WO 88/07963 | 10/1998 |

OTHER PUBLICATIONS

M. Joseph–Eugene Baptise, "DE Voyage ET DE Campement, ECT", Dec. 16, 1921.

*Primary Examiner*—Timothy L. Maust
(74) *Attorney, Agent, or Firm*—Fish & Richardson P.C.

(57) ABSTRACT

A pressurized dispensing system (10) for dispensing a multi-component product, comprises an outer body (11) defining a first chamber (8) constructed to contain a first component of said product; an inner container (20), disposed within said body, defining a second chamber (7) constructed to contain a second component of said product and maintain said second component separate from said first component; a dispensing head (50), in fluid communication with said first (8) and second (7) chambers, through which the product is dispensed; and a modular valve assembly (5), including a valve constructed to move between a closed position, in which said first and second chambers are sealed, and an open position, in which said first and second components flow simultaneously from said first and second chambers to said dispensing head.

18 Claims, 20 Drawing Sheets

U.S. PATENT DOCUMENTS 3,894,659 A 7/1975 Focht
3,940,026 A 2/1976 Kain
3,951,310 A 4/1976 Steiman
3,976,223 A 8/1976 Jass et al.
4,222,499 A 9/1980 Lee et al.
4,387,833 A 6/1983 Venus, Jr.
4,423,829 A 1/1984 Katz
4,492,313 A 1/1985 Touzani
4,651,503 A 3/1987 Anderson, III et al.
4,727,914 A 3/1988 Anderson, III et al.
4,733,702 A 3/1988 Anderson, III et al.
4,964,540 A 10/1990 Katz
5,370,250 A 12/1994 Gilbert
6,196,275 B1 * 3/2001 Yazawa et al. ..... 141/3
6,299,024 B1 10/2001 Corba

* cited by examiner

SYSTEM FOR DISPENSING MULTI-COMPONENT PRODUCTS

This application is a divisional (and claims the benefit of priority under 35 U.S.C. § 120) of U.S. Ser. No. 10/283,033, filed Oct. 29, 2002, now U.S. Pat. No. 6,789,702 which is a continuation of PCT/US01/15912, filed May 17, 2001, which is a continuation-in-part of U.S. Ser. No. 09/574,312, filed May 19, 2000 abandoned.

TECHNICAL FIELD

The present invention relates to systems for dispensing multi-component products.

BACKGROUND

It is often necessary, or desirable, to maintain one component of a multi-component product, e.g., a shaving cream, separate from other components of the product or from some part of the container in which the product is stored.

For example, the components of the product may react with each other when mixed, and it may be desired to prevent this reaction from occurring until the product is dispensed.

Moreover, in some cases it is important to keep one component of a multi-component product from contacting the container holding the product due to the reactive nature of the particular component, e.g., if the component reacts with metals and the container is metal or includes metal parts such as springs.

Other reasons for maintaining one component separate from other components include aesthetic reasons, e.g., to provide a "stripe" of one color against a background of another color when the product is dispensed.

Various systems have been used in the past to package and dispense products containing two components so that the components are separated during storage and mixed during or just prior to dispensing, e.g., as disclosed in U.S. Pat. Nos. 3,241,722 and 3,454,198.

SUMMARY

The present invention provides systems for dispensing multi-component products. Preferred systems maintain one component of the product completely separate from other components until the product is dispensed. Because the components do not contact each other until the instant that the product is dispensed, products including highly reactive components can be effectively dispensed. The systems are easily filled using mass production techniques, and preferred systems include a dispensing valve assembly that has a convenient modular design, allowing it to be easily assembled into the dispensing system.

In one aspect, the invention features a pressurized dispensing system for dispensing a multi-component product, including (a) an outer body defining a first chamber constructed to contain a first component of the product; (b) an inner container, disposed within the body, defining a second chamber constructed to contain a second component of the product and maintain the second component separate from the first component; (c) a dispensing head, in fluid communication with the first and second chambers, through which the product is dispensed; and (d) a modular valve assembly, including a valve constructed to move between a closed position, in which the first and second chambers are sealed, and an open position, in which the first and second components flow simultaneously from the first and second chambers to the dispensing head.

In some implementations, the modular valve assembly includes a valve cup and a valve body, together defining a chamber, and, within the chamber, a valve subassembly and an upper valve seal. The valve subassembly may include a valve stem including a first valve portion for sealing against the first valve seal to seal the first chamber and a second valve portion for sealing against the second valve seal to seal the second chamber, a lower valve seal, and a spring for biasing the valve stem towards its closed position. Preferably, the valve stem is a single unitary member, and is a female stem.

In another aspect, the invention features a method of filling components into a pressurized dispensing system for dispensing a multi-component product, including (a) placing an inner, flexible container within an outer container so that open ends of the inner and outer containers are adjacent; (b) mounting a valve assembly in sealing engagement with the open ends of the containers; and (c) delivering the components into the inner and outer containers through the valve assembly.

In a further aspect, the invention features a method of assembling a dispensing system for dispensing a multi-component product, including (a) mounting an inner container in fluid communication with a modular valve assembly; (b) inserting the inner container and valve assembly into an outer body; (c) sealingly joining a rim portion of the modular valve assembly to a rim portion of the outer body; (d) forming a sealed canister comprising the outer body and the valve assembly; and (e) pressurizing the sealed canister.

In yet another aspect, the invention features a method of filling components into a pressurized dispensing system for dispensing a multi-component product, including (a) placing an inner flexible container, and an outer flexible container within an outer rigid container so that open ends of the inner and outer flexible containers and the outer rigid container are adjacent; (b) mounting a valve assembly in sealing engagement with the open ends of the containers; and (c) delivering the components into the inner and outer flexible containers through the valve assembly.

In some implementations, a propellant is charged to the space between the outer flexible container and the outer rigid container prior to step (c). The method may also include evacuating the inner and outer flexible containers, preferably after charging the propellant and prior to step (c).

The term "pressurized", as used herein, is intended to encompass both pressurization as a result of a propellant and pressurization resulting from other causes, e.g., a mechanical force applied by a spring.

Other features and advantages will be apparent from the following description of a presently preferred embodiment, and from the claims.

DETAILED DESCRIPTION

Figure 1:
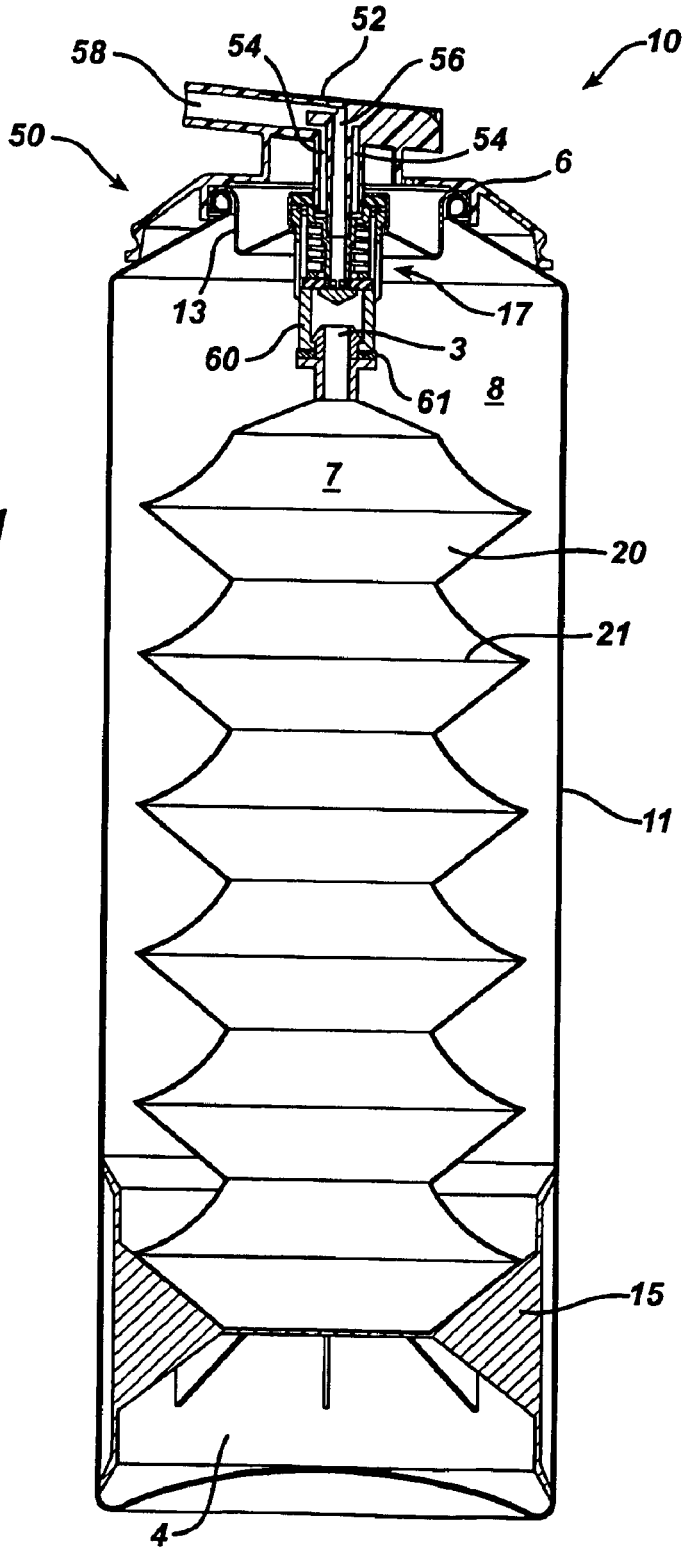
FIG. 1 is a cross-sectional view of a dispensing system according to one embodiment of the invention.

A preferred dispensing system 10 is shown in FIG. 1. Dispensing system 10 includes a canister 11 and, within canister 11, an elongated bag 20 having pleated sides 21 that form a bellows. Canister 11 defines a first chamber 8, for containing a first component, and bag 20 defines a second chamber 7, separated from the first chamber 8, for containing a second component. A valve cup 13, which is generally formed of metal, is crimped around a circumferential rim 6 of canister 11, forming a sealed container that can be pressurized.

Figure 3:
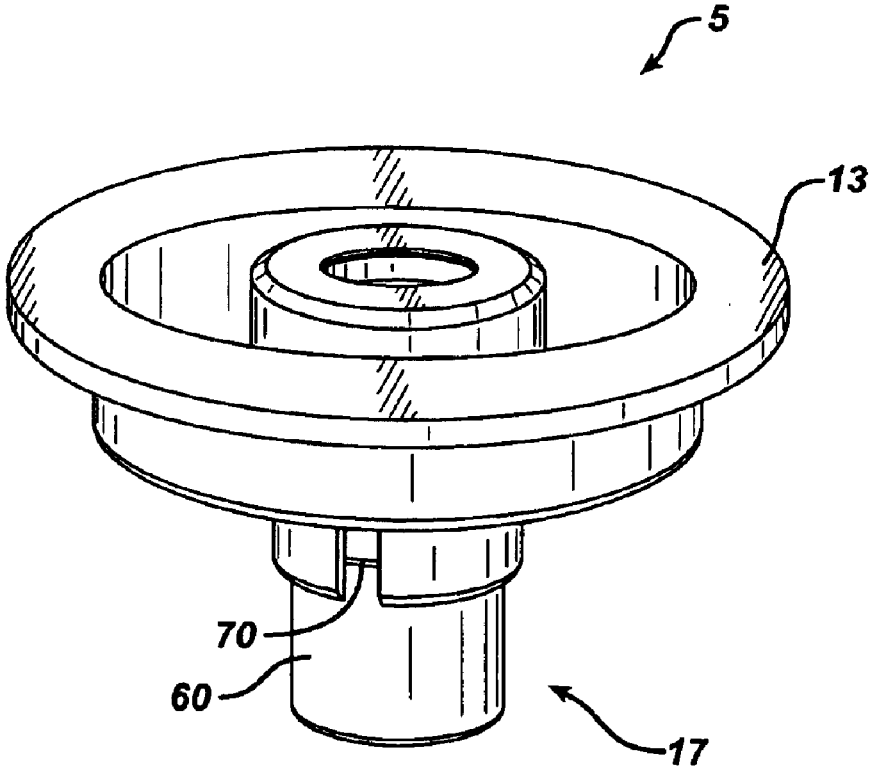
FIG. 3 is a perspective view of the modular dispensing valve assembly of the system of FIG. 1, removed from the dispensing system.
Figure 3B:
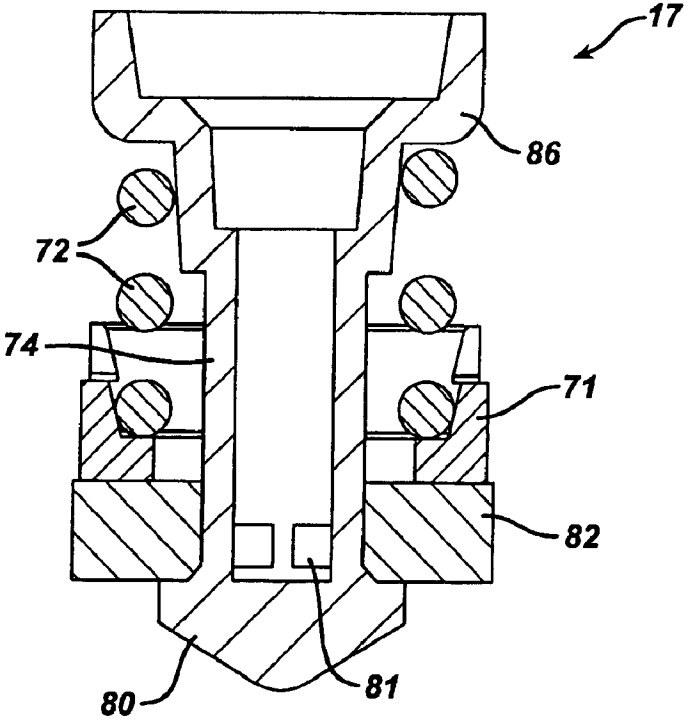
FIG. 3B is a cross sectional view of a valve sub-assembly used in the modular valve assembly.

Valve cup 13 includes a central valve opening 14, into which is mounted a self-contained valve subassembly 17, forming a modular valve assembly 5 (FIG. 3). The internal components of the valve subassembly 17, discussed in detail below, are pre-assembled for ease of manufacture. Thus, it is not necessary to assemble a number of loose parts during manufacture of the dispensing system 10, resulting in significant cost savings. The valve subassembly 17, shown in FIG. 3B, includes a valve stem 74, spring 72, valve seal 82, and washer 71, all of which are discussed below. These components are pre-assembled by placing the spring 72 over the stem 74, followed by the washer 71. Then the valve seal 82 is pressed onto the stem, which holds the working components of the valve tightly together. The subassembly 17 can then be transported as a unit to conventional mounting cup assembly equipment for final assembly into the modular valve assembly 5, shown in FIG. 3.

Figure 3A:
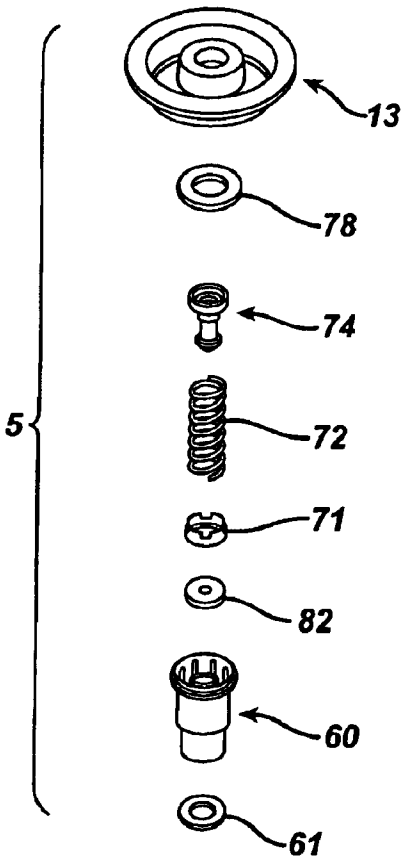
FIG. 3A is an exploded view of the modular valve assembly.

As shown in FIG. 3A, the modular valve assembly 5 includes, in addition to the components of the valve subassembly 17, the valve cup 13, a valve body 60, a valve seal 78, and a bag seal 61. The modular valve assembly may be assembled by dropping the valve subassembly 17 into the valve body 60, applying the valve seal 78, and crimping the valve cup 13 to the valve body 60.

The modular valve assembly 5 can be easily dropped into the canister 11 and crimped onto rim 6 during high-speed manufacturing. This operation can be performed on empty containers, which are subsequently pressurized and filled as will be described in detail below. The lower end of the valve subassembly 17 is positioned in fluid communication with the outlet 3 of the elongated bag 20.

A dispensing head 50 is mounted over the valve cup 13, and includes an actuator 52 that includes a living hinge that allows the actuator to be depressed by a user and, when so depressed, to actuate valve subassembly 17 as will be described below. Dispensing head 50 defines a first channel 54, for flow of the first component from chamber 8, and a coaxially disposed second channel 56, for flow of the second component from chamber 7. Channels 54 and 56 are in fluid communication with nozzle 58, through which the product is dispensed.

A piston 15 sealingly and slidably engages the inner surface of the canister 11, defining a propellant chamber 4 that is constructed to receive a propellant canister (not shown) to pressurize the dispensing system. The sealing engagement of piston 15 with the inner wall of canister 11 effectively prevents propellant from entering chamber 8. Sliding movement of piston 15 towards the dispensing head 50, caused by the pressure exerted by the propellant, forces both components out through the nozzle 58 evenly and consistently when the actuator 52 is depressed by a user, opening the valve subassembly. As the product is exhausted, the piston 15 will compress the bag 20, and pleats 21 will collapse like a bellows until substantially all of the second component in chamber 7 is exhausted.

Figure 2:
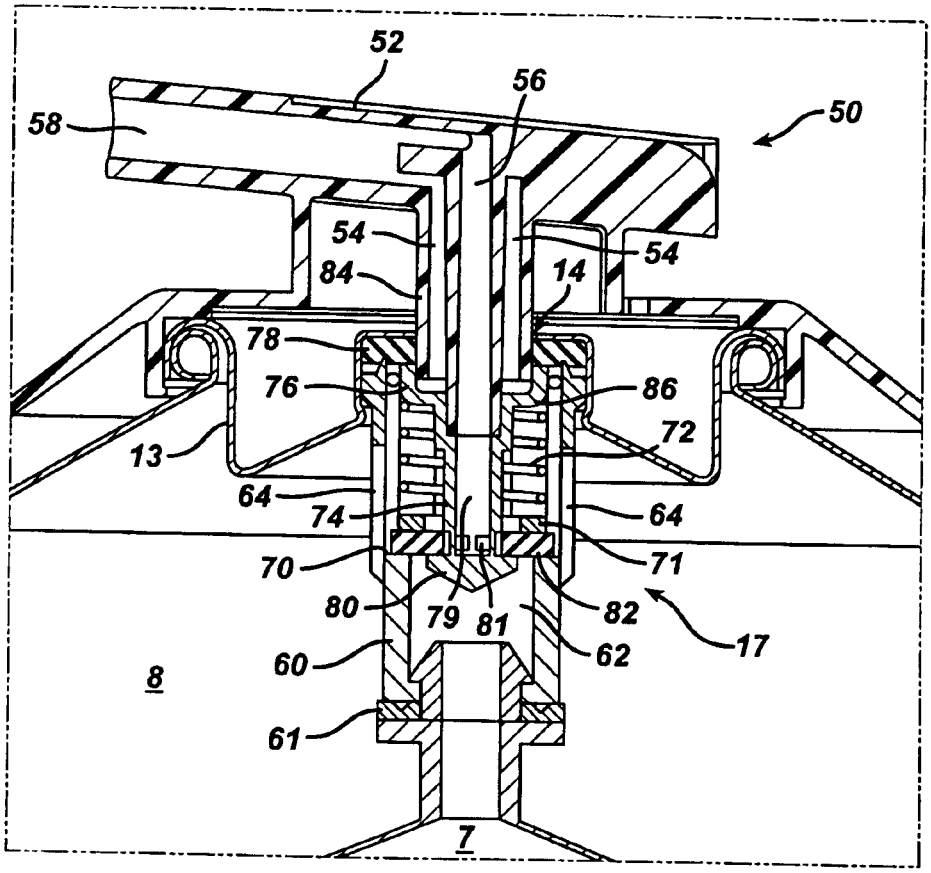
FIGS. 2 and 2A are enlarged detail views of the dispensing valve of the dispensing system of FIG. 1, with the valve shown in a closed position and an open position, respectively.
Figure 2A:
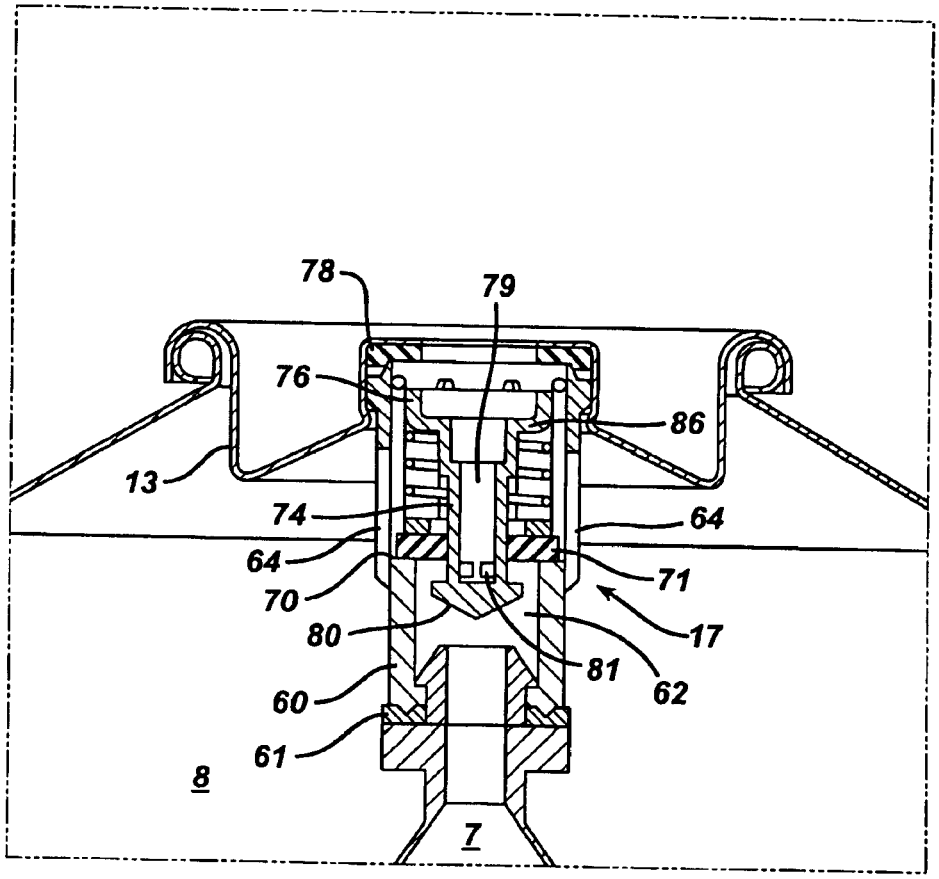
Figure 4:
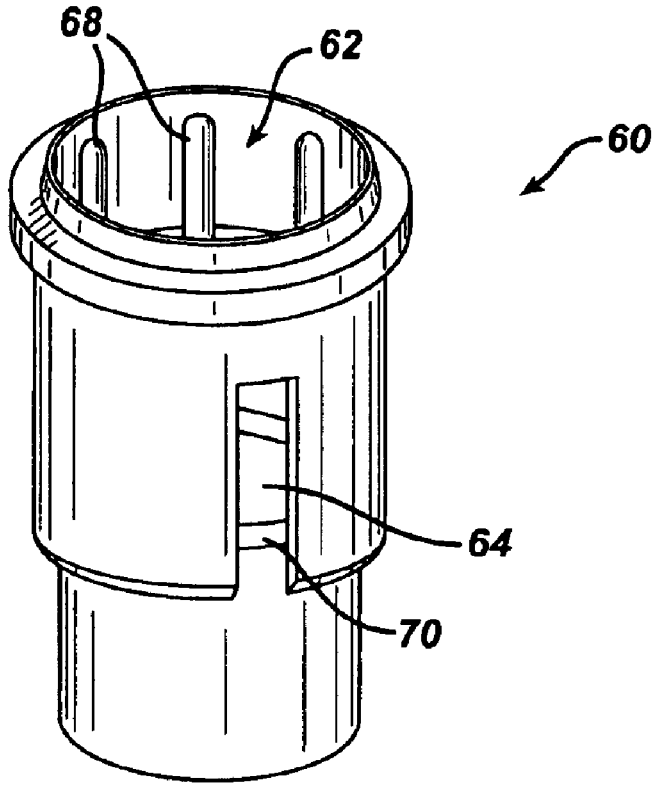
FIG. 4 is a perspective view of the valve body of the valve assembly shown in FIG. 3.

The operation of valve subassembly 17 will now be discussed, with reference to FIGS. 2 and 2A. Valve subassembly 17 includes a valve body 60, shown in detail in FIG. 4, which is constructed to be mounted on valve cup 13 and crimped in place. Valve body 60 defines a central passage 62 (FIG. 2), and a plurality of side openings 64. Inner wall 66 of valve body 60 includes a plurality of ribs 68 and a shoulder 70 (FIG. 4), to support a spring 72 (FIG. 2). Valve stem 74 is mounted within spring 72, which biases first valve portion 76 against first valve seal 78 and second valve portion 80 against second valve seal 82, so that both valve portions are biased towards a closed position. Preferably valve seals 78 and 82 are resilient gaskets, to provide a fluid-tight seal when the valve is in a closed position as shown in FIG. 2. Valve stem 74 also includes a central bore 79, in communication with passage 56 of the dispensing head, and a plurality of openings 81 which are unavailable for fluid flow from chamber 7 when the valve is closed, but which allow the second component to flow from chamber 7 into passage 56 when the valve opens.

Dispensing head 50 includes an actuating stem 84, which extends into and seats in a cup-shaped area 86 of the valve stem 74. When actuator 52 is depressed, actuating stem 84 presses valve stem 74 down, against the biasing force of spring 72. This movement simultaneously moves both valve portions away from the corresponding valve seals, moving the dispensing system to its open position, shown in FIG. 2A. Importantly, the two valves are opened simultaneously, and no material is released from either chamber into the passages to the nozzle until the actuator is depressed. When the valves are opened, the first component flows from chamber 8, through openings 64 in the valve body and past valve portion 76, into passage 54. Simultaneously, the second component flows from chamber 7, through openings 81 in the valve stem and into passage 56.

Advantageously, the openings 64 and 81 are relatively large, preferably as large as can be accommodated by the design constraints of the valve body and valve stem. The large valve openings allows a high flow rate into the nozzle during filling of the dispensing system, and minimizes shear on the first and second components during filling and dispensing. Preferably, the total area of openings 64 is at least about 0.007 $in^2$, more preferably at least about 0.015 $in^2$, and the total area of openings 81 is at least about 0.002 $in^2$, more preferably at least about 0.0035 $in^2$. These areas are the theoretical design measurements; the actual areas of the openings are subject to tolerances and distortion of the valve during installation into the container. The area of the openings is selected to allow the first and second components to be delivered into the container through the valve during a high-speed manufacturing process. It is desirable to fill through the valve because doing so facilitates high-speed in-line processing, and because, in some implementations (e.g., when the system includes a liner bag as will be discussed below), this technique allows the propellant to be charged to the container prior to filling. Charging the propellant prior to filling allows substantially all air to be evacuated from the container, which in turn prevents problems with the product such a premature foaming.

The use of a female valve stem allows design room to provide these relatively large openings. Using a female valve stem also allows the flow rate of the components out of the container to be controlled by the actuator, rather than by the valve. It is generally easier to accurately control the flow at the last point of exit (the actuator), rather than at the valve openings. Preferably, the valve stem is a single, unitary part, for ease of manufacturing and economy.

Figure 5:
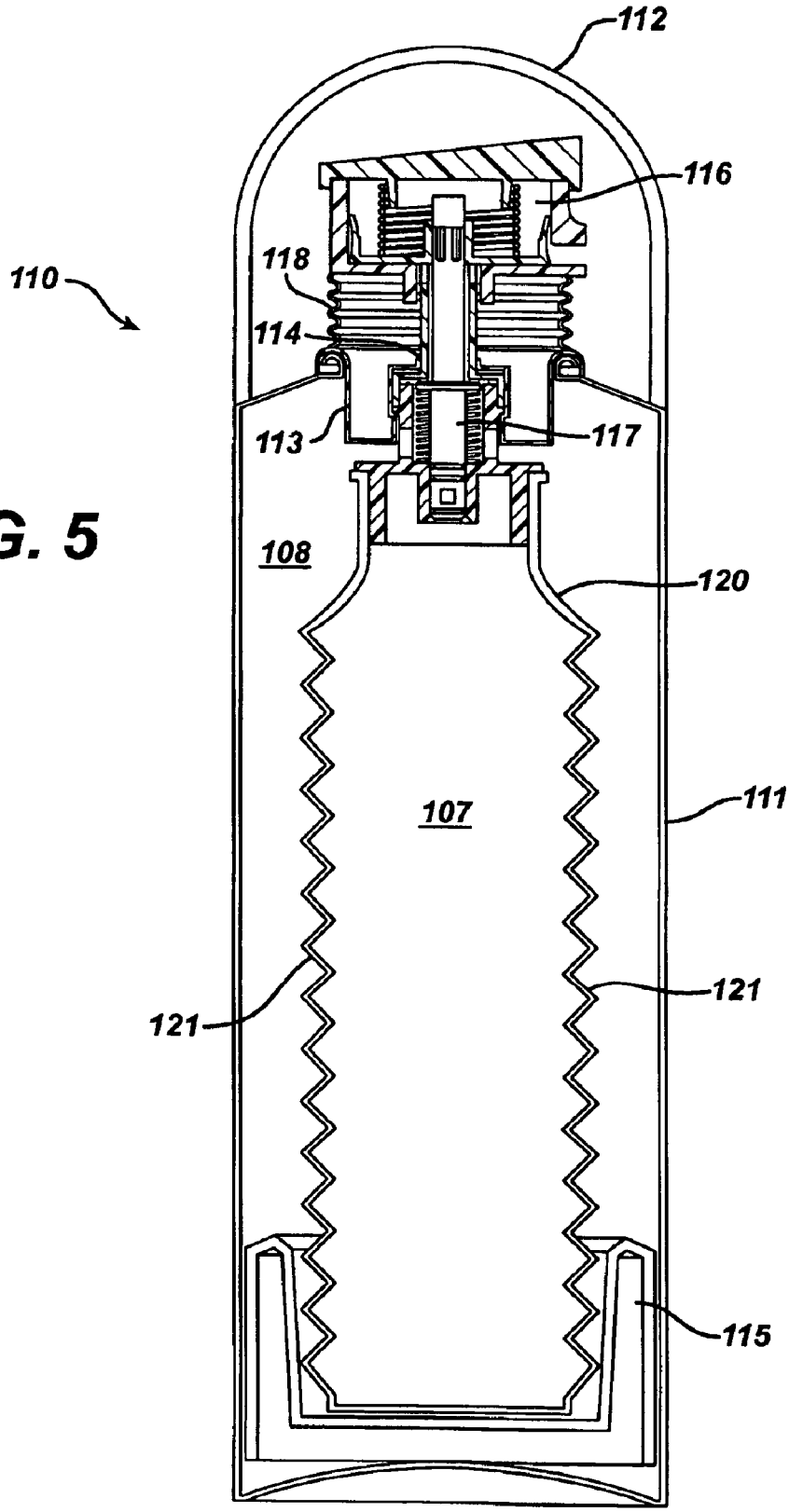
FIG. 5 is a cross-sectional view showing a dispensing system according to an alternative embodiment of the invention.

A dispensing system 110, according to an alternate embodiment of the invention, is shown in FIG. 5. Dispensing system 110 is similar to dispensing system 10. Dispensing system 110 differs in that it includes a mixing head 116, for mixing the separate components during dispensing. (It is noted, however, that a mixing head may be included in the system shown in FIGS. 1–4, if desired.) The valve assembly used in dispensing system 110 is also somewhat different from the valve assembly discussed above, in that the valve stem used in dispensing system 110 is a male valve stem, rather than a female valve stem. These features will be discussed in detail below.

Like the dispensing system 10, discussed above, dispensing system 110 includes a canister 111 and, within canister 111, an elongated bag 120 having pleated sides 121. A valve cup 113 provides a central valve opening 114 into the canister 111. A cylindrical piston 115 sealingly engages the inner surface of the canister 111 and is capable of slidable movement within the canister. A valve assembly 117, discussed in further detail below, extends from within the canister 111 through the valve opening 114, the lower end of the valve assembly 117 being directed into the elongated bag 120. The canister 111 and the bag 120 define a chamber 108 therebetween, and the bag 120 defines a chamber 107.

Dispensing system 110 further includes a mixing head 116 that is external of the canister 111 and is operatively attached to a valve assembly 117, and crimped to the rim of the valve cup 113. A flexible shroud 118 may be included for decoration. The structure and function of mixing head 116 will be discussed further below, with reference to FIGS. 6 and 6A, in which the dispensing system 110 is shown fully assembled, including the mixing head 116, in its closed (storage) and open (dispensing) conditions, respectively.

Figure 8:
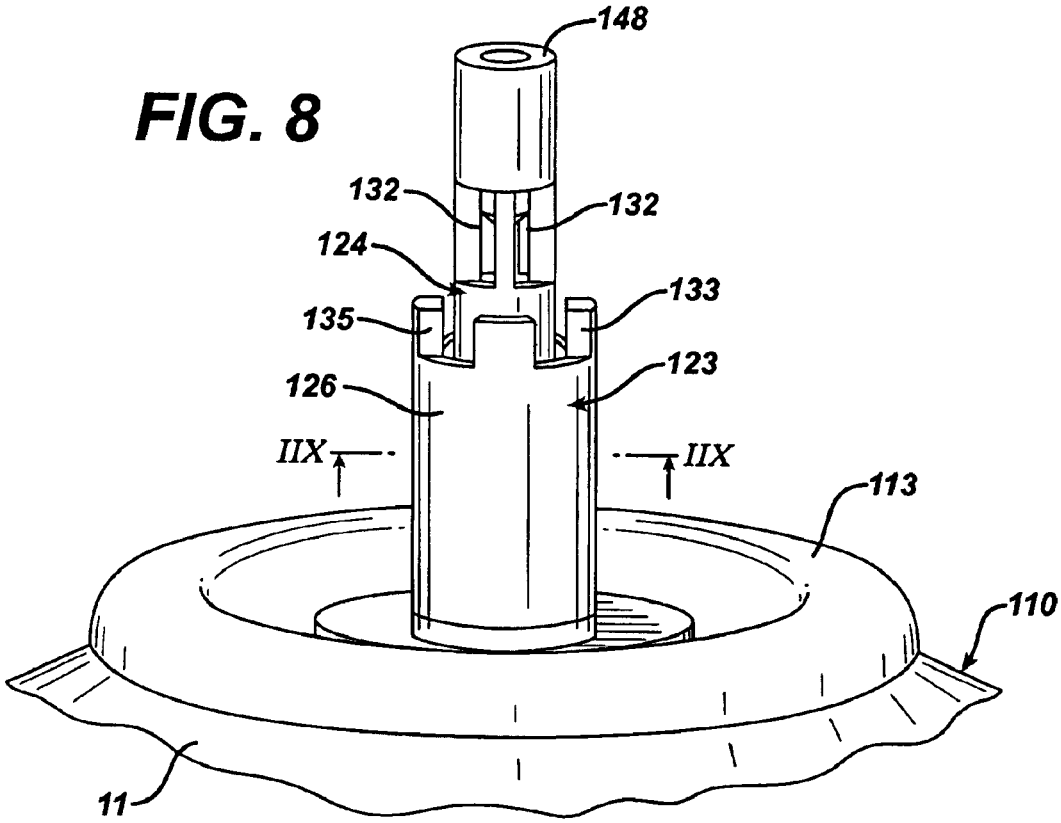
FIG. 8 is a fragmentary elevational perspective view of the dispensing system of FIG. 5, with the dispensing and mixing heads removed for clarity.

The mixing head 116 includes an actuator shell 142, a cover 143, a piston 145 sealingly engaged at the inner surface of the shell 142, and a helical spring 146 disposed between the inner surface of the cover 143 and the upper surface of the piston 145, biasing the piston to its lowermost position in contact with the inner surface of the shell 142. A plug 148, shown in detail in FIG. 8, is positioned in the inner valve stem 124.

Shell 142 defines a side opening 151, and a central opening 152, and includes a downwardly extending flange 154 that is in slidable, interfitting engagement with the outer surface of the outer valve stem 126. The lower surface of the piston 145 is in contact with the upper end of outer valve stem 126, and inner valve stem 124 extends upwardly into the shell 142. An upwardly extending flange 153 of the piston 145 surrounds and is slidable relative to inner valve stem 124. The entire mixing head 116 is slidably movable due to the slidable engagement of the flanges 153 and 154 with the valve stems 124 and 126. The flexible shroud 118 is in contact with the bottom surface of the shell 142 and the upper surface of the valve cup 114, both for decorative purposes and to maintain the outer surface of the valve stem 126 in condition for slidable movement of the shell thereon.

Figure 6:
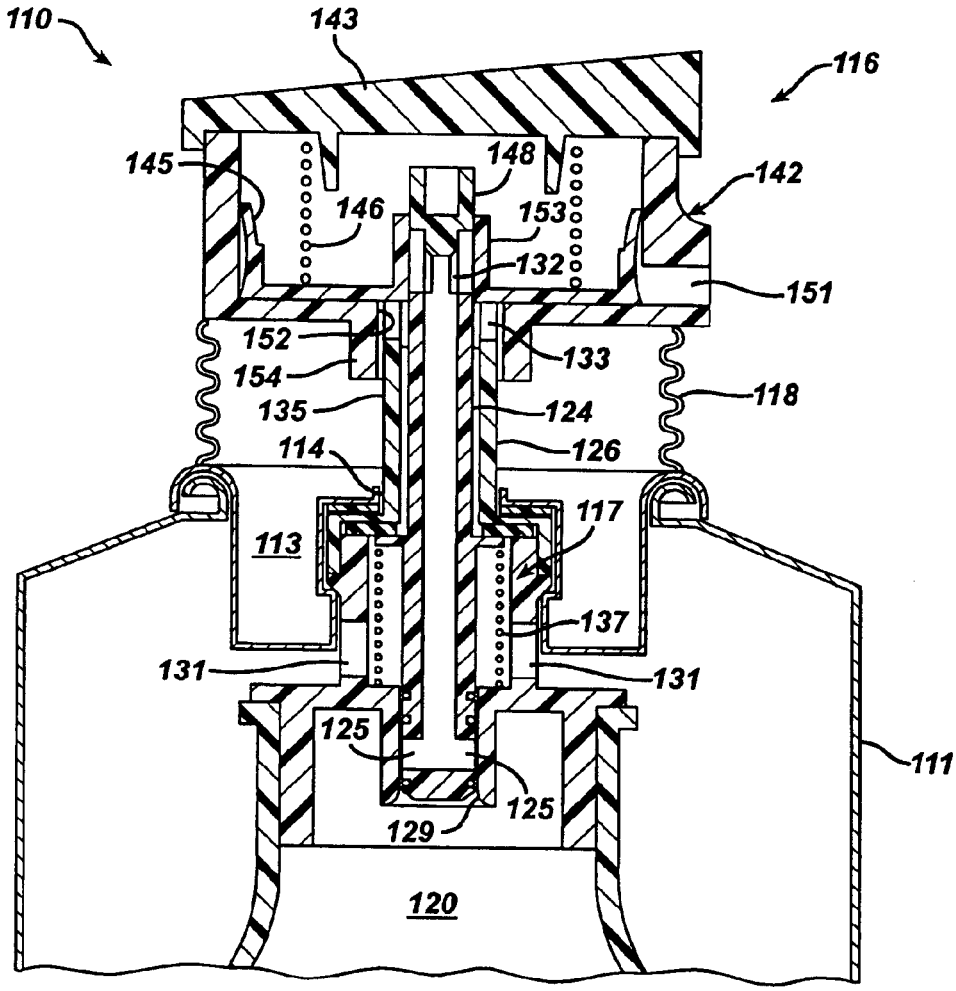
FIGS. 6 and 6A are enlarged detail views of the dispensing system of FIG. 5 in a closed and an open position, respectively, with the dispensing head in place.

With the mixing head 116 in place, the elongated conduit 135 is closed off by flange 136, the opening 125 is contained within the valve body member 127, and the materials within the canister 111 and the bag 120 remain in place under pressure during storage (FIG. 6).

Figure 6A:
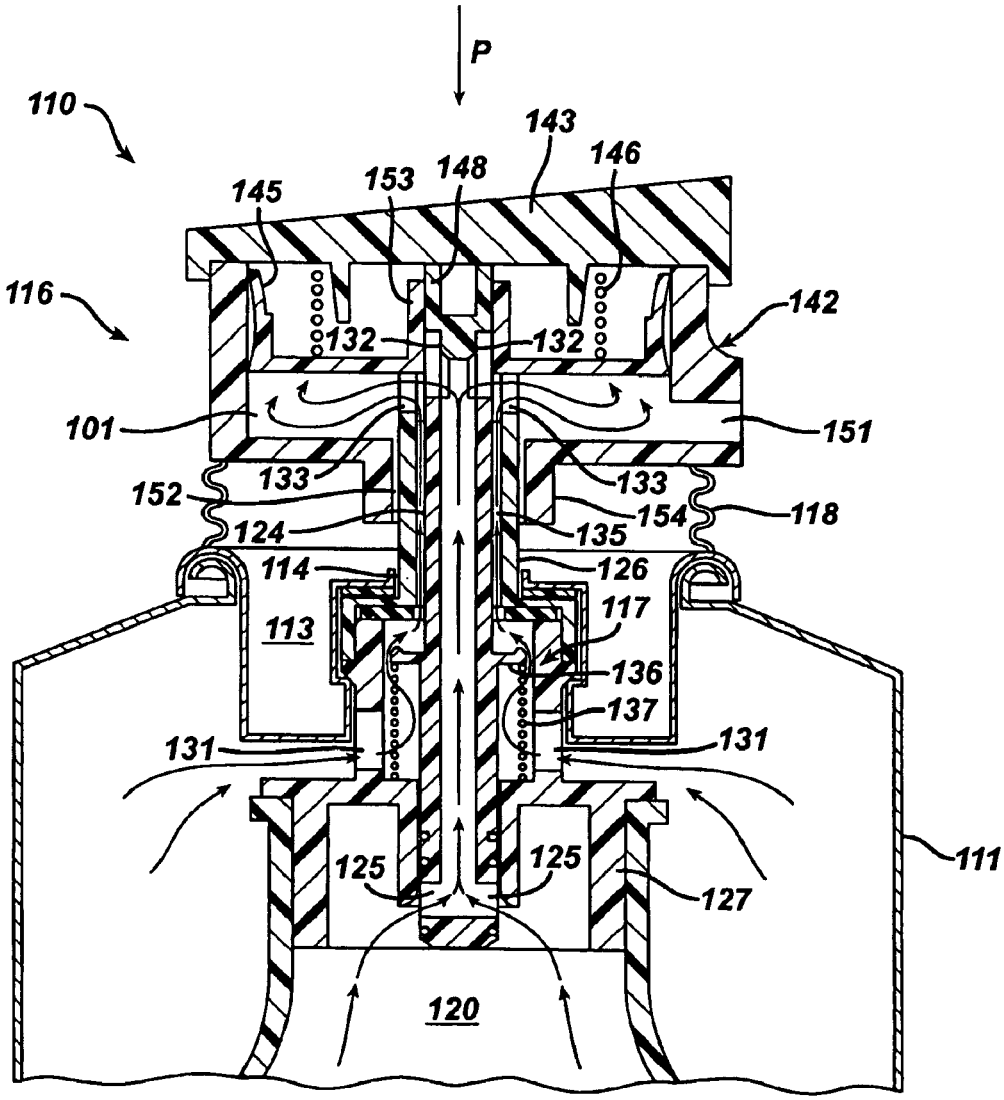

Referring to FIG. 6A, mixing and dispensing of the components is accomplished by applying downward pressure (arrow P) to the cover 143 of the shell 142, bringing the inner surface of the cover into contact with the plug 148. This in turn moves the piston 145 out of contact with the bottom surface of the shell 142 until the piston bottom is against the upper end of the outer valve stem 126, which stops the piston from moving as the shell 142 is moved downwardly. This movement of the piston provides an open chamber 101 to receive the components when the valve assembly 117 is opened.

As shell 142 moves down, the piston 145 continues to be separated from the bottom surface of the shell 142, and contact of the plug 148 with both the lower surface of the cover 143 and the upper end of the inner valve stem 124 causes the inner valve stem 124 to move downwardly to open the conduit 135 and the inner passage of the inner valve stem 124, causing flow of material as indicated (arrows, FIG. 6A). As shown in FIG. 8, the top of the inner valve stem 124 and the outer valve stem 126 provide slotted openings, so that both components are dispensed radially outwardly in all directions, causing mixing of the components in mixing chamber 101. As a result, there is generally a substantial mixing of the components during dispensing, the amount of mixing accomplished being dependent on the rheology of the particular components.

When the pressure is released from the cover 143, the piston 145 returns to its initial position, in which its lower surface is in full contact with the inner surface of the shell 142, and the mixing head 116 is completely evacuated. In cases in which the components are reactive, it may be desirable or necessary that the mixing head be evacuated in this manner, to prevent damage to the mixing head by the reacting components.

Advantageously, the bag 120, cylinder piston 115 and valve assembly 117 are constructed so that the elements of the assembly will nest one with the other when the product is almost fully dispensed (and thus the bag 120 has again collapsed), leaving only a small residual amount of product in the canister 111 at the end of its life.

Each of the elements of the mixing head 116, with the exception of the spring 146, which does not contact the constituent materials, is generally constructed of a plastic material. The mixing head is preferably constructed as a separate unit and then applied to the dispensing system 110 after the system has been filled.

Figure 7:
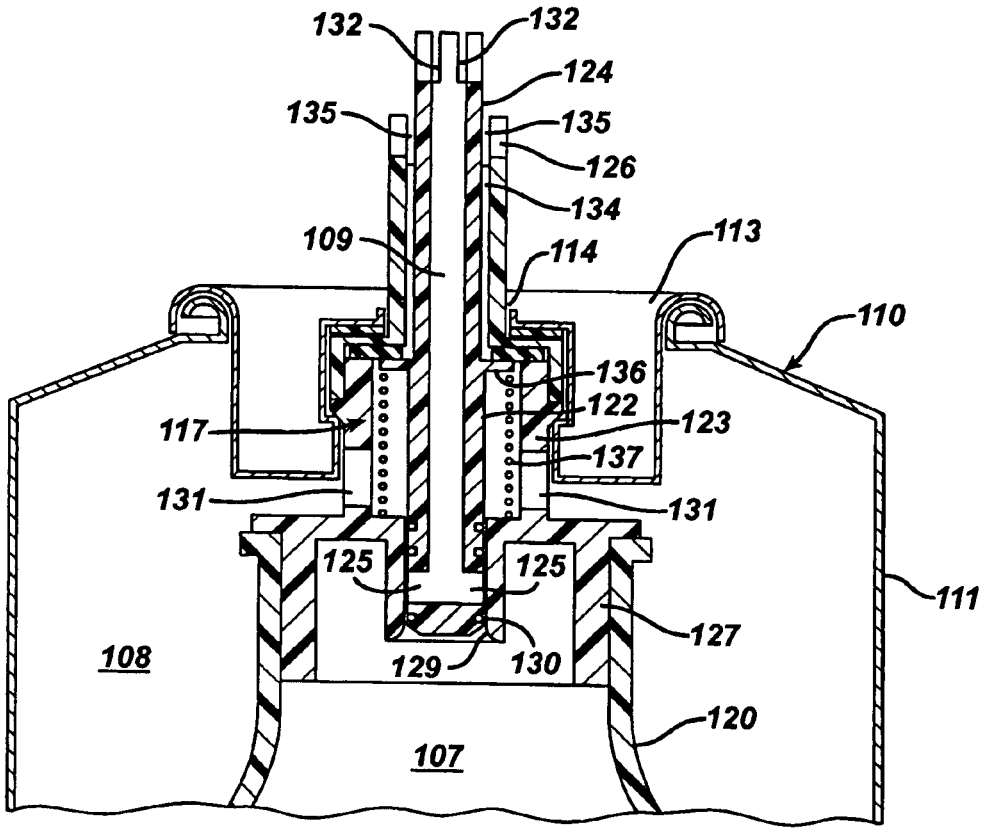
FIGS. 7 and 7A are enlarged detail views showing the valve portion of the dispensing system of FIG. 5 in a closed position and an open position, respectively, with the dispensing head removed for clarity.
Figure 7A:
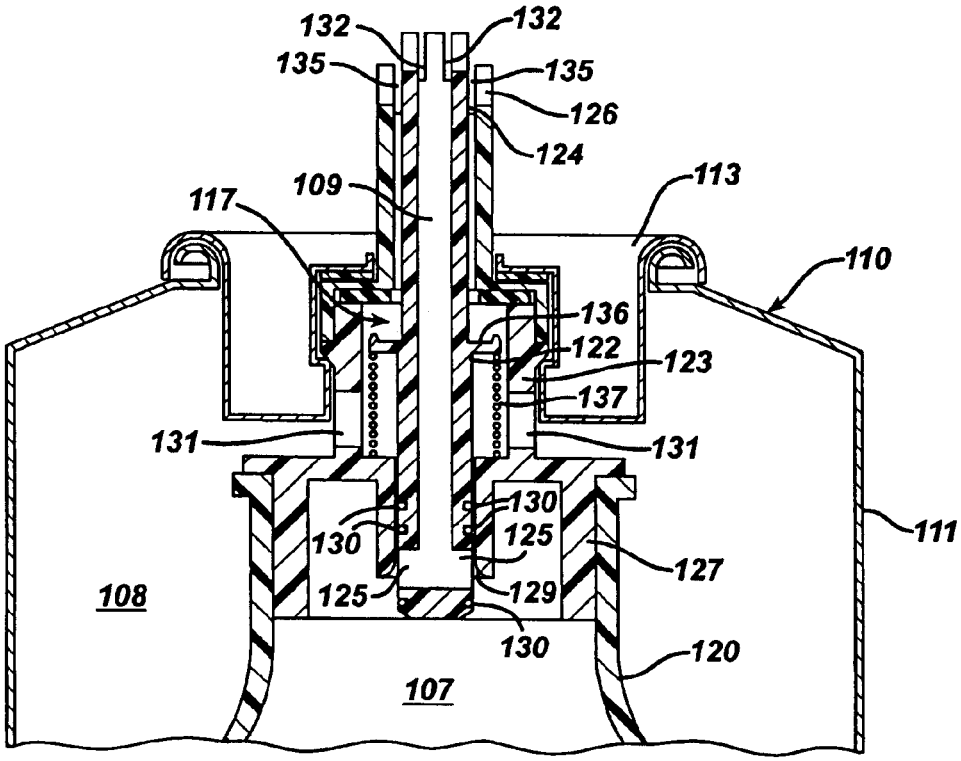

Referring now to FIGS. 7 and 7A, the valve assembly 117 is shown with the mixing head 116 removed for clarity (this also shows the condition of the dispensing system during filling of the components into the dispensing system). The valve assembly 117 includes an inner valve 122 and an outer valve 123, the inner valve being substantially enclosed by and movable relative to the outer valve. The inner valve 122 and outer valve 123 are preferably formed of a rigid plastic material. The inner valve consists of an elongated, cylindrical inner valve stem 124 that defines a passage 109 and a pair of openings 125 formed near the bottom of the valve stem. The outer valve 123 includes a cylindrical, elongated outer valve stem 126, which is locked into place in the valve cup 113 by valve body member 127.

The inner valve 122 is disposed with the lower end of the inner valve stem 124 extending through an opening 129 in the valve body member 127, the inner valve stem 124 having O-rings 130 for sealing the valve stem against the body member 127 during slidable movement of the valve stem. Openings 131 are provided in the valve body member 127, providing fluid communication between the outer surface of the inner valve stem 124 and the canister 111.

Figure 9:
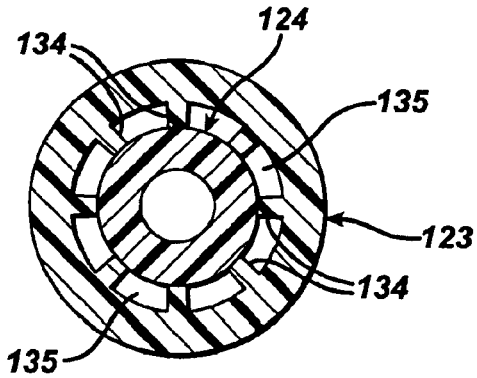
FIG. 9 is a planar sectional view taken along the line IIX—IIX of FIG. 8.

The inner valve stem 124 includes four radially extending openings 132 at its uppermost end, and the outer valve stem 126 likewise has four radially extending openings 133 at its uppermost extension (FIGS. 8 and 9). The outer valve stem 126 further has a plurality of axially disposed, inwardly extending support fins 134 which contact the inner valve stem 124 and form an elongated conduit 135 between the inner valve stem 124 and the outer valve stem 126. The inner valve stem 124 has a radially outwardly extending flange 136 which is effective to close conduit 135 when the inner valve 122 is biased upwardly by helical spring 137, as shown in FIG. 7.

The inner valve 122 and the outer valve 123 are shown in a closed position in FIG. 7, and in an open position in FIG. 7A. The path of flow of the components through the valve when the valve is open is shown by the arrows in FIG. 6A. To open the valve during dispensing or filling, the inner valve 122 is moved downwardly relative to the outer valve 123 against the bias of the spring 137, thereby opening the elongated conduit 135 into the canister 111 through the opening 131, and the inward path through the valve stem 122 into the bag 120 through the openings 125.

The method by which the dispensing systems of the invention are filled with the components of the product will now be explained, with reference to FIGS. 10–10A and 11–11A. The method will be discussed with reference to dispensing system 110; dispensing system 10 is filled in a similar manner, the only difference being in the type of fixture used (a male or female fixture is selected, as appropriate, depending on the type of valve stem employed).

Figure 10:
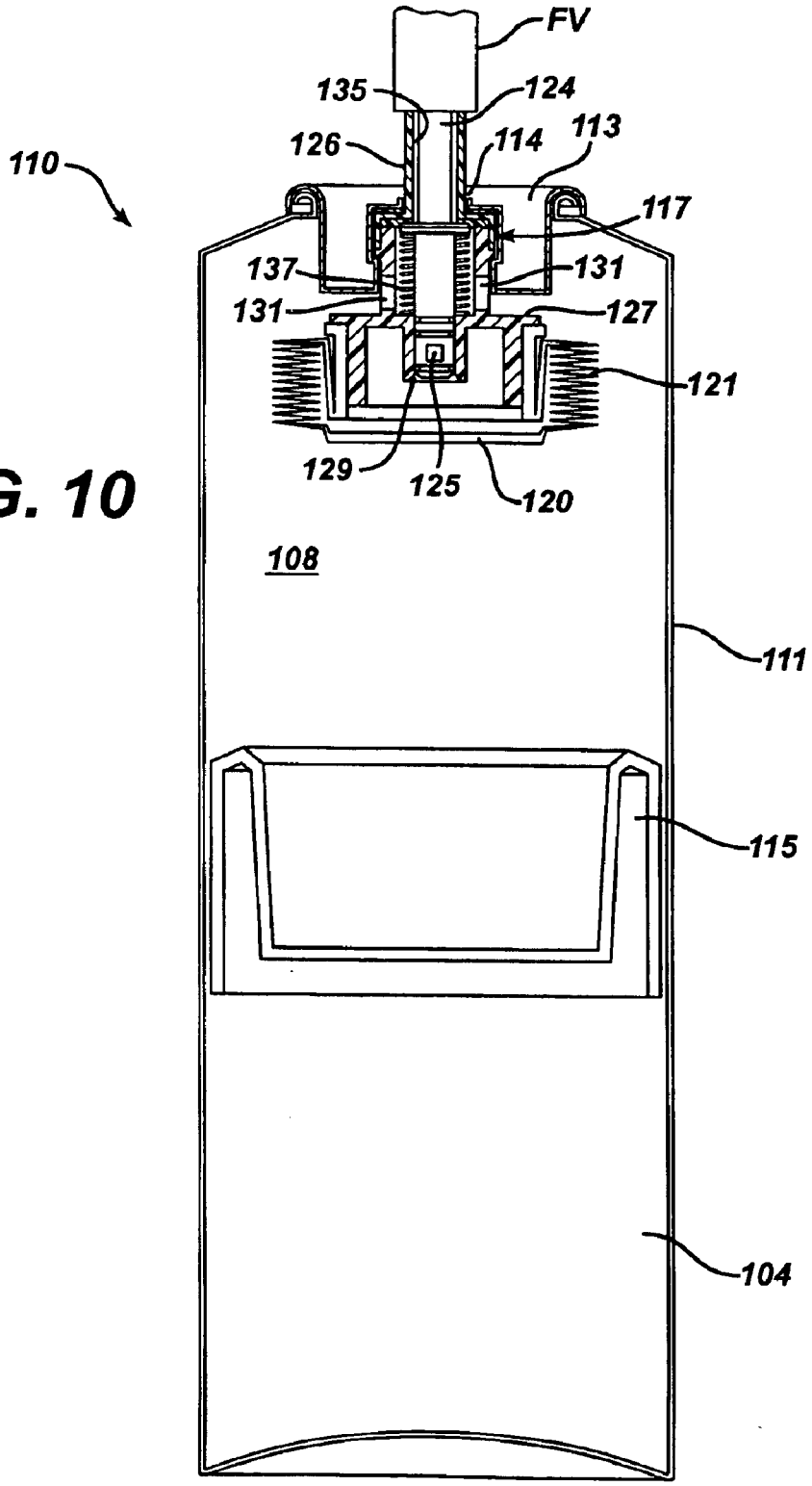
FIGS. 10 and 10A are cross-sectional views showing a portion of the dispensing system of FIG. 5 prior to filling.
Figure 10A:
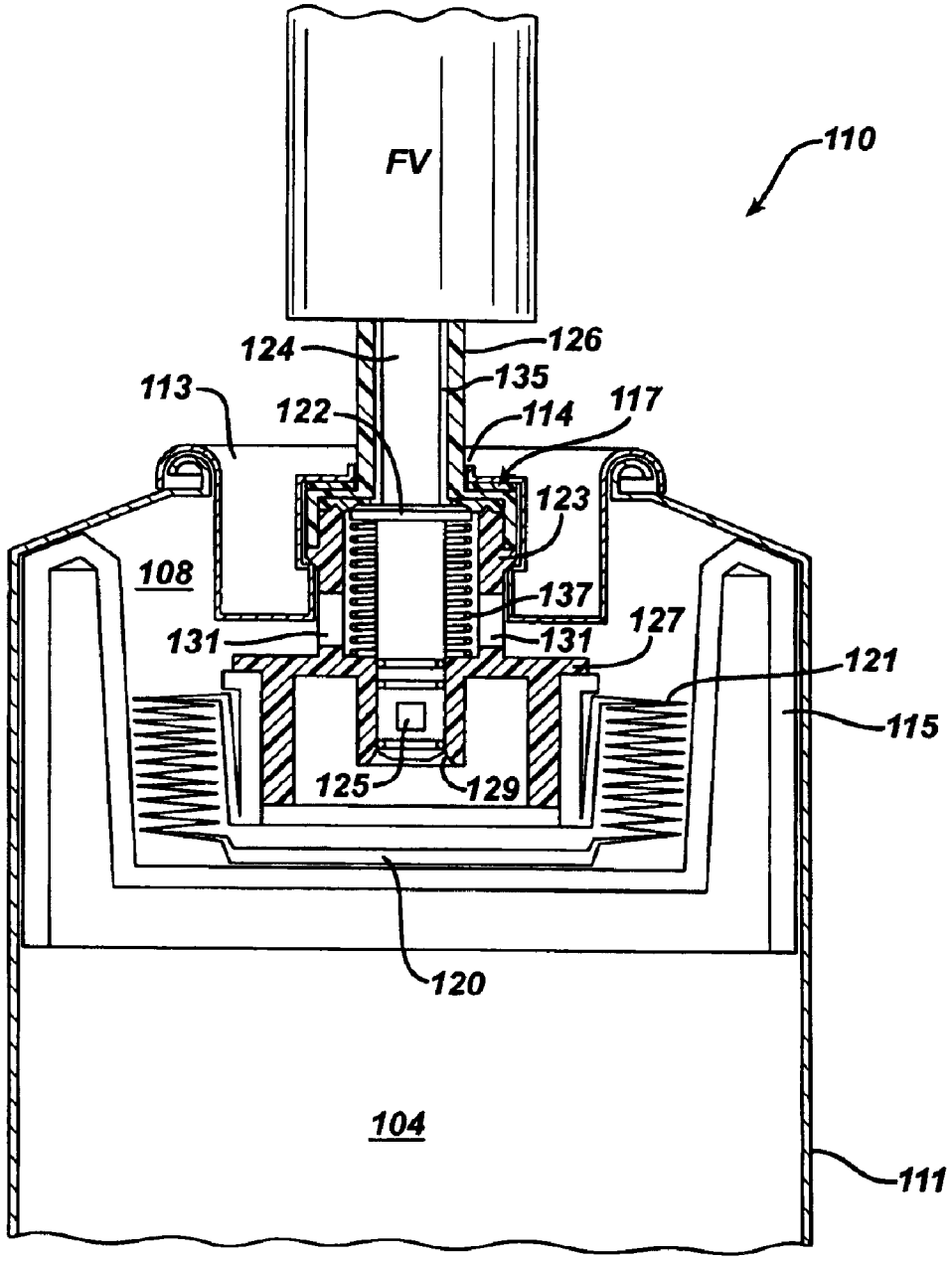

Referring to FIGS. 10 and 10A, prior to introduction of the components into the canister 111, a fixture FV is placed onto the valve stems 124 and 126, and depressed to place the valve assembly 117 in the open position. A vacuum is then drawn to evacuate air from the bag 120 and canister 111, so that the pleated sides 121 are compressed, as shown in FIG. 10. Simultaneously or alternatively, pressure is applied through a grommet (not shown) which is generally located at the bottom of the canister 11, forcing the cylindrical piston 115 upwardly in the canister 111 to assume the position shown in FIG. 10A. The downward pressure on the valve assembly 117 is now released, the valve returns to its closed position, and the fixture FV is removed.

Figure 11:
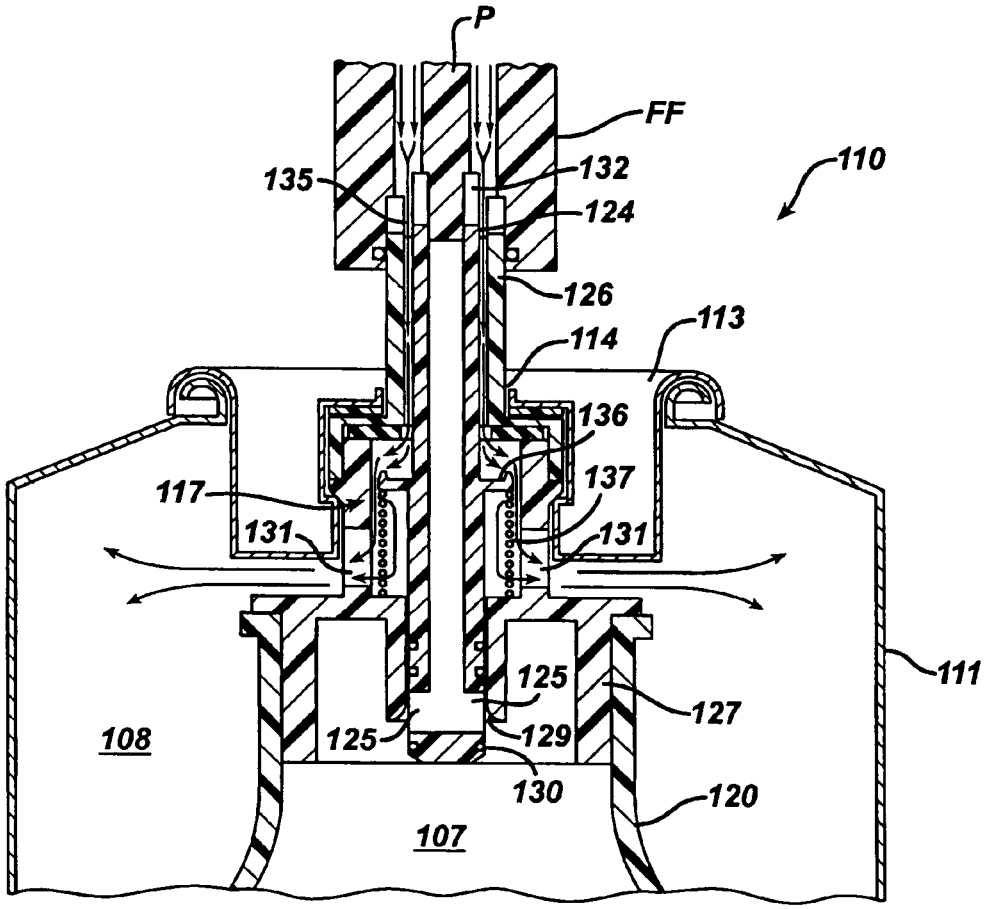
FIGS. 11 and 11A are cross-sectional views showing flow of material into the dispensing system, through the valve assembly, during filling.

Next, a first component is filled into chamber 108, between canister 111 and bag 120. Referring to FIG. 11, a second fixture FF is applied to the valve assembly 117, the fixture FF having a central plug P which is inserted into the valve stem 124 beyond the openings 132 and is sealingly engaged to the outer surface of the outer valve stem 126. Plug P thus seals the passage of the inner valve stem 124, while opening the valve assembly 117. The reactant material is then forced downwardly (arrows, FIG. 11), through the elongated conduit 135 and outwardly through the openings 131 into the canister 111, forcing the cylindrical piston 115 downwardly and away from the bag 120 toward the position shown in FIG. 10. Fixture FF is then removed, causing the valve assembly 117 to close due to action of the spring 137.

Figure 11A:
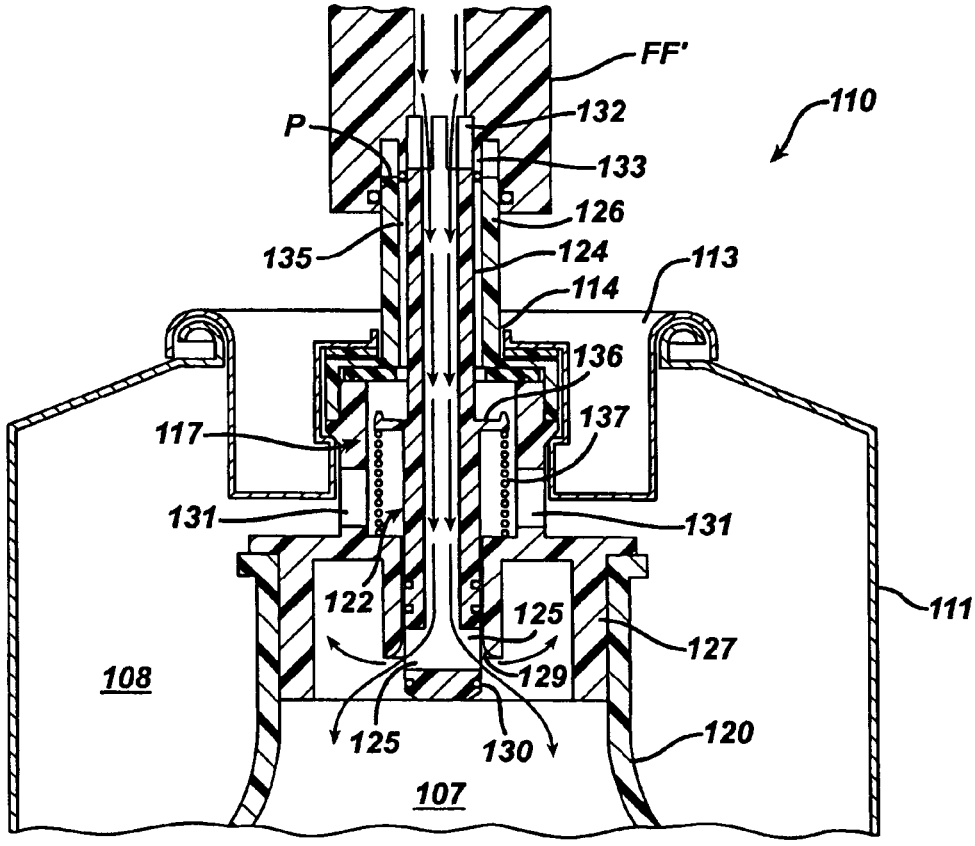

Referring now to FIG. 11A, a second component is introduced into the bag 120, using a second filling fixture FF'. Fixture FF' has a central opening that is constructed to contact the valve stem 124 at an annular portion P, which sealingly engages the elongated conduit 135 to prevent release of the already deposited material from within the canister 111 when the valve assembly 117 is in the open position. The fixture FF' is forced downwardly, so that it moves the valve stem 124 downwardly to open the valve. Material is then forced from the fixture FF' through the inner valve 122 and outwardly through the opening 125 into the bag 120. The bag 120 is also forced downwardly by internal pressure to assume the position shown in FIG. 5, in which the bag contacts the cylindrical piston 115.

The fixture FF' is then removed, allowing the valve assembly 117 to return to the closed position. Thus, both of the components are sealed within the canister 111, separated from each other by the bag 120.

It is generally necessary to fill the dispensing system in the order described above, i.e., to fill the outer chamber 108 first, followed by the inner chamber 107. Otherwise, a vacuum may be formed within the dispensing system, preventing proper filling.

In this implementation, it is generally preferred that the propellant be charged to the container after the outer chamber and inner chamber have been filled. It is also generally preferred that the time between filling steps be minimized, particularly if one or both of the components contains a blowing agent which could expand prior to pressurization of the system.

Figure 12:
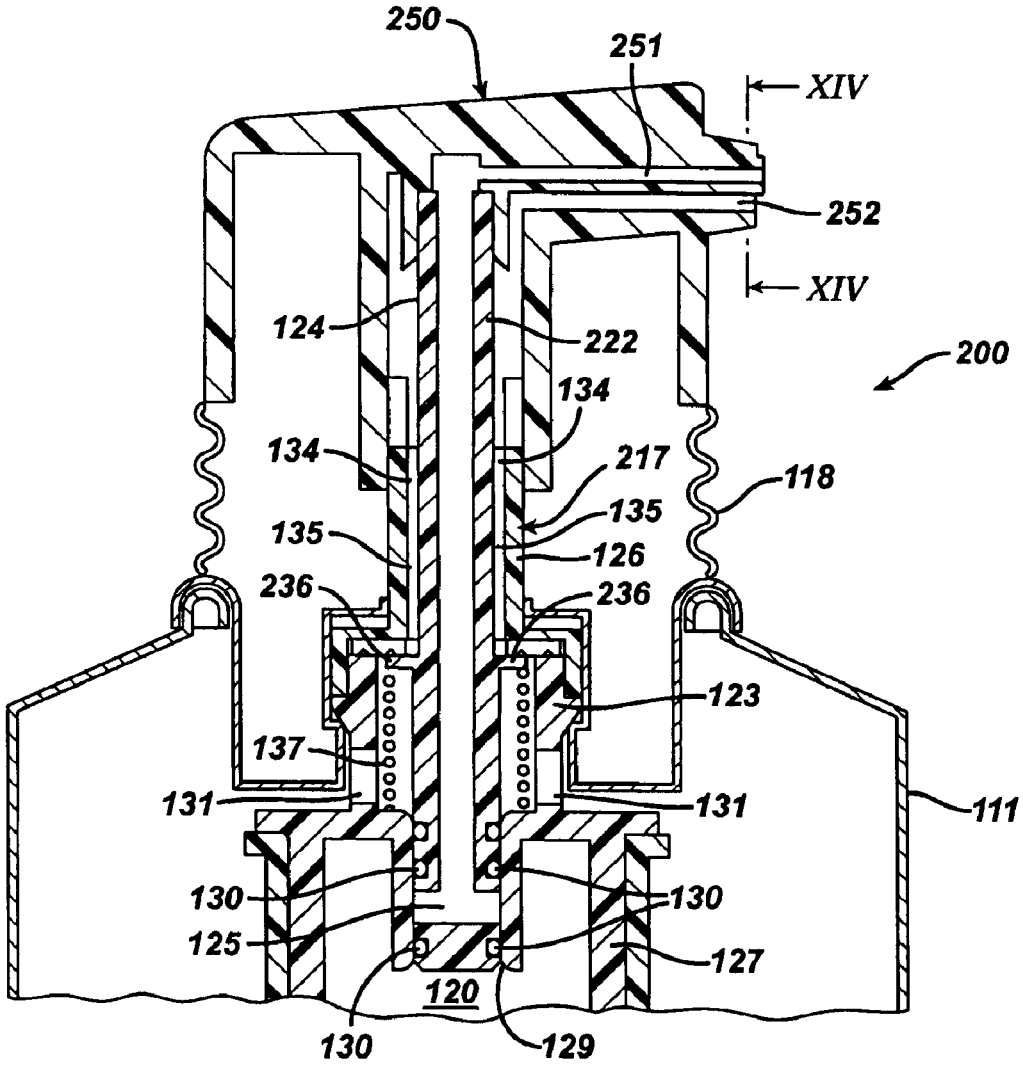
FIGS. 12 and 12A are a fragmentary cross-sectional views of a dispensing system according to another alternative embodiment of the invention, with the valve assembly in a closed position and an open position, respectively.
Figure 13:
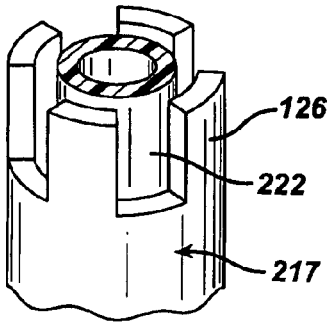
FIG. 13 is an elevational fragmentary perspective view showing details of an element of the structure of FIG. 12.
Figure 14:
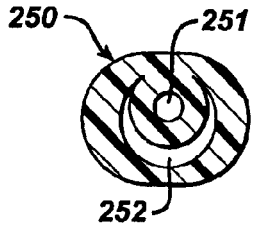
FIG. 14 is a sectional view, taken along line XIV—XIV of FIG. 12, showing details of the nozzle.

An alternate embodiment of the invention, similar to the embodiment shown in FIGS. 1–4 in that mixing occurs outside of the device, is shown in FIGS. 12–14. The dispensing device of FIGS. 12–14 differs from that of FIGS. 1–4 in that it includes a male valve stem rather than a female valve stem. The device shown in FIGS. 12–14 is also similar to the dispensing device 110, shown in FIGS. 5–7A, except that mixing occurs outside of the device.

Like the dispensing device 110, the dispensing device 200 includes a canister 111, valve cup 113 and valve opening 114. Elongated bag 120 has pleated sides and is compressed by a cylindrical piston as described above. Valve structure 217 includes an inner valve 222 and an outer valve 123, the outer valve 123 being identical to that shown in FIGS. 5–7A and discussed above. The inner valve 222 differs from the inner valve 122 in that inner valve stem 224 extends upwardly to a greater extent than the inner valve stem 124, as shown in FIG. 12. The outer valve stem 126 has support fins 134, which contact the inner valve stem 224, and the inner valve stem 224 has a radially outwardly extending flange 236, which closes conduit 135, as described above with regard to the previous embodiment.

Mixing head 116 of the previously described dispensing system is replaced by actuator 250, which is cylindrical and generally formed of a plastic material. The actuator 250 is provided with a pair of conduits 251 and 252, the conduit 251 having an opening into the inner valve stem 224 and the conduit 252 opening into the elongated conduit 135, as shown in FIG. 12. The conduits 251 and 252 open to the atmosphere and may be slightly angled toward one another at their exit point to insure intermingling of the materials as they exit the actuator 250. To further enhance intermingling of the materials as they exit the dispensing device 200, the conduit 251 is circular in cross-section, while the conduit 252 is crescent shaped (FIG. 14). Conduit 252 is formed around the conduit 251 to ensure convergence of the materials, and appropriate mixing as the components exit the dispensing device 200.

Figure 12A:
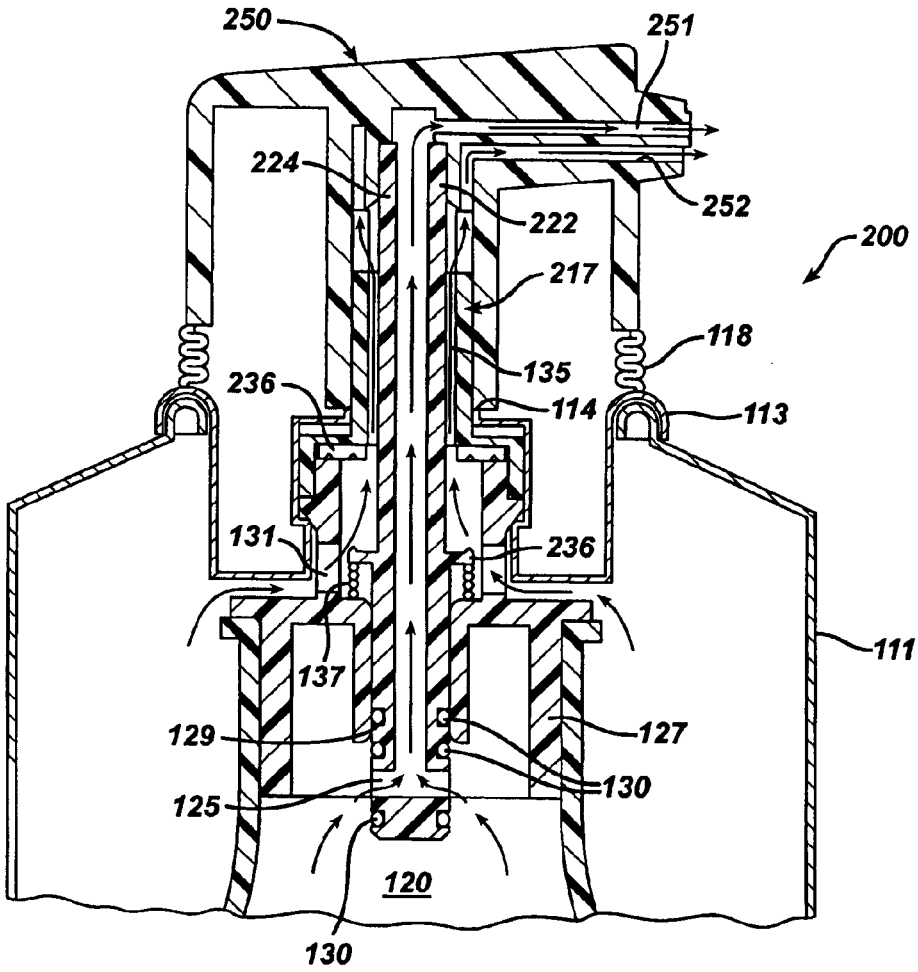

As shown in FIG. 12, during storage of the dispensing device 200 the conduit 135 is closed off by flange 236, and the pair of openings 125 are contained within the valve body member 127. Thus, the materials within the canister 111 and the bag 120 remain in place and under pressure. Referring to FIG. 12A, by applying a downward pressure to the upper surface of the actuator 250, a force is applied to the top of the inner valve stem 224, forcing it downward and compressing the spring 137. As the inner valve stem 224 moves down, the flange 236 is moved from its sealing position and material flows from within the canister 111 through the elongated conduit 135 and outwardly from the conduit 252 (arrows, FIG. 12A). Simultaneously, as the inner valve stem 224 moves downwardly, the openings 125 are released from within the valve body member 127 and material flows from the bag 120 upwardly through the inner valve stem and outwardly through the conduit 251, the two components being combined outside of the actuator 250. Upon release of pressure from the upper surface of the actuator 250, the spring 137 returns the inner valve stem 224 to the position shown in FIG. 12 and the components are again retained under pressure within the canister 111 and the bag 120.

Filling of the components into the canister 111 and the bag 120 is accomplished in a manner similar to that previously described, with only slight alteration of the fixtures FF and FV to accommodate the differences between valve structures 117 and 217.

Figure 15:
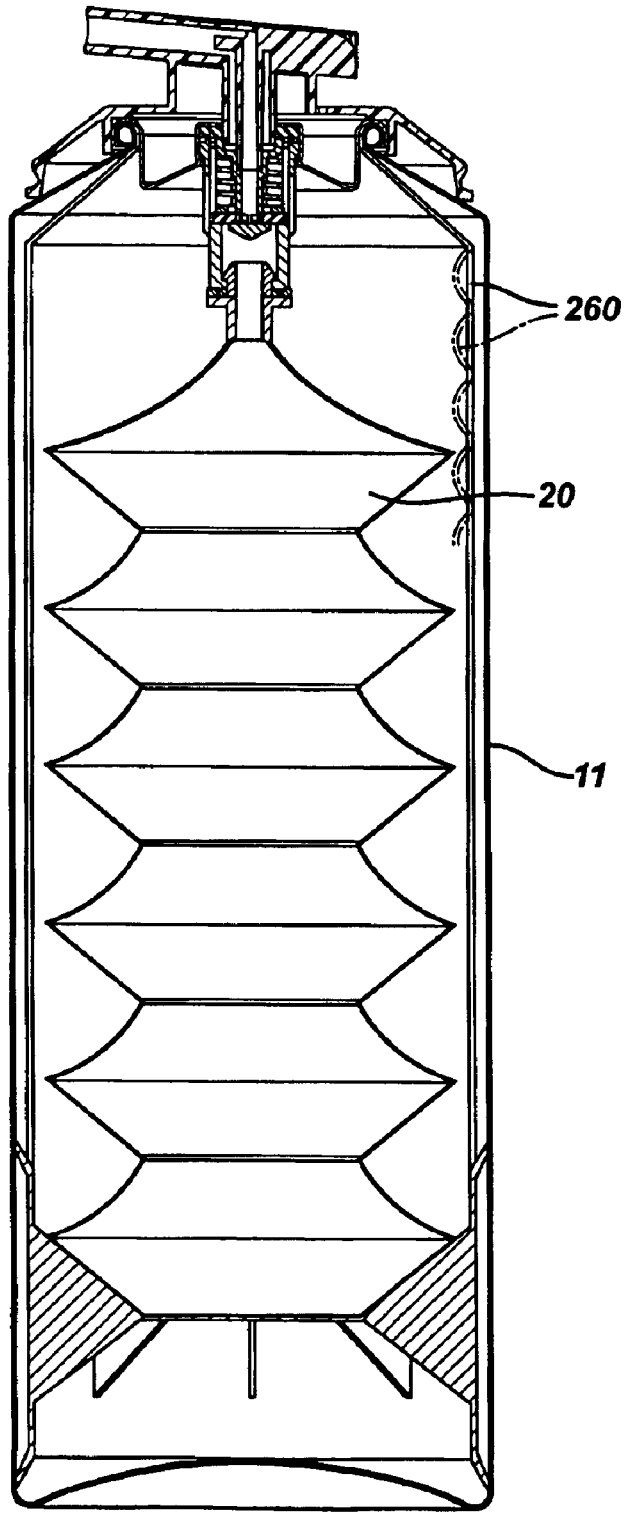
FIG. 15 is a cross-sectional view showing a dispensing system according to an alternate embodiment of the invention.

In another alternate embodiment, shown in FIG. 15, the dispensing system includes a liner bag 260 between the canister 11 and the elongated bag 20. A liner bag may be included, for example, if the component to be stored outside of the elongated bag 20 is reactive with the metal canister. In this embodiment, although a piston is shown in FIG. 15 it is not necessary to include a piston, unless it is essential that the two components be dispensed in a 1:1 ratio. Eliminating the piston will generally reduce cost and simplify assembly, and thus it may be desirable to use this configuration even if the component is not reactive with the metal canister.

Moreover, providing the liner bag allows the propellant to be charged to the canister, between the liner bag and the canister, prior to delivering the other components to the canister. Because the canister is pressurized prior to delivery of the components, neither component will expand after it is delivered, and there is no need to minimize the time between filling steps. The ability to deliver the propellant first provides flexibility in manufacturing.

Suitable propellants for use in the systems described above generally have room temperature vapor pressures in the range of 15 to 48 pounds per square inch. The can may be sealed using a Nicholson or umbrella style grommet seal, or no seal if a rope grommet is used. For the Nicholson style grommet, a pin is used to push the grommet in place and seal the can. The umbrella grommet is self-sealing. A rope grommet apparatus, such as that manufactured by Terco Inc., seals the can by pushing a rubber plug into the orifice.

EXAMPLE

A dispensing system without a piston, including a liner bag and an inner bag, was manufactured using the following procedure. The liner bag and inner bag defined first and second chambers, which were filled with a multi-component product, in this case a shave gel formulated to foam in the user's hand. Using the process described below, air was removed from the container prior to filling, preventing premature foaming of the finished shave gel.

First, a modular valve assembly (as described above) was attached to the inner bag.

The modular valve assembly was then crimped onto the can using a standard aerosol valve collet crimping process. The crimping collet deformed the valve shell to seal the valve assembly onto the can top curl. The outer liner bag was crimped between the valve cup portion of the modular valve assembly and the can curl.

The next step was the injection of propellant into the bottom chamber of the can. The can was placed in an apparatus that sealed around the bottom orifice of the can with a sealing surface. The apparatus then injected a propellant into the bottom of the can and sealed the can.

Vacuum was drawn through the modular valve assembly, to remove air from the two chambers and collapse the liner bag and inner bag. This was accomplished at the same time as the propellant injection, but could be accomplished at a separate station.

The vacuum was drawn using an adapter that sealed the vacuum source to the valve assembly and opened both the inner and outer chambers simultaneously. Because the valve stem used was female, the adapter used a hollow male pin to actuate the valve and a soft sealing material to rest against the top of the valve cup orifice. The male pin was designed to depress the valve spring to expose the inner chamber orifice and had vent groves to access the outer chamber as well.

After vacuum was drawn, the can was ready to be filled with the shaving gel concentrate. Because the can was under pressure, it was possible to maintain vacuum in the inner and outer chambers for an extended period of time.

Using a concentrate filling and blending device, the concentrates were blended with a blowing aid prior to injection into the package through the aerosol valve. The blending apparatus had a static mixer to preblend the blowing aid with the concentrate. (Static mixers from Koflo, Chemineer Kenics and Sultzer are suitable. Shear rates for the static mixers should be in the range of 10 to $10^4$ 1/sec.).

After blending with the static mixer, the concentrate/blowing aid mixture was further sheared to fully emulsify the blowing aid. Shear rates in the order of $10^4$ to $10^6$ 1/sec were used. (An orifice plate such as those described in U.S. Pat. Nos. 4,733,702, 4,727,914 and 4,651,503, incorporated by reference herein, can provide suitable shear rates. Orifice plates can be from 1 to 6 holes ranging in orifice diameter of 0.020" to 0.070". In this experiment, a 4 hole, 0.046" diameter orifice plate was used. Shearing can also be accomplished using a valve-type spring plate such as that manufactured by Aerofill (UK)).

Concentrate filling occurred next. The outside liner bag was filled first. The sheared concentrate was filled into the pressurized container. Pressure prevented the concentrate from expanding into foam because the internal pressure generated from the vapor pressure of the driving propellant was greater than the vapor pressure of the blowing aid.

The sheared concentrates were filled into the container using adapters that sealed off one chamber at a time, while allowing the other chamber to fill. To fill the outer chamber, the filling adapter sealed the inner chamber orifice from the concentrate flow path. The concentrate then was directed to the outer chamber flow path by redirecting the concentrate radially into the valve. The concentrate flow path was split into two ports on the adapter. (The flow path can be split into two to four paths. The number of ports effects the shear the adapter imparts on the concentrate and the flow rate of the concentrate into the valve).

The inner chamber was filled last. To fill the inner chamber, the outer chamber flow path was sealed from concentrate flow and the adapter actuated the inner chamber flow path.

The external dimensions of the adapters were the same. The difference was the flow path of the adapter. There were only radial holes in the outer bag-filling adapter, while there were no radial holes in the inner bag-filling adapter, but instead only a central flow path that led directly to the inner bag orifice of the valve.

Other embodiments are within the claims.

Figure 16:
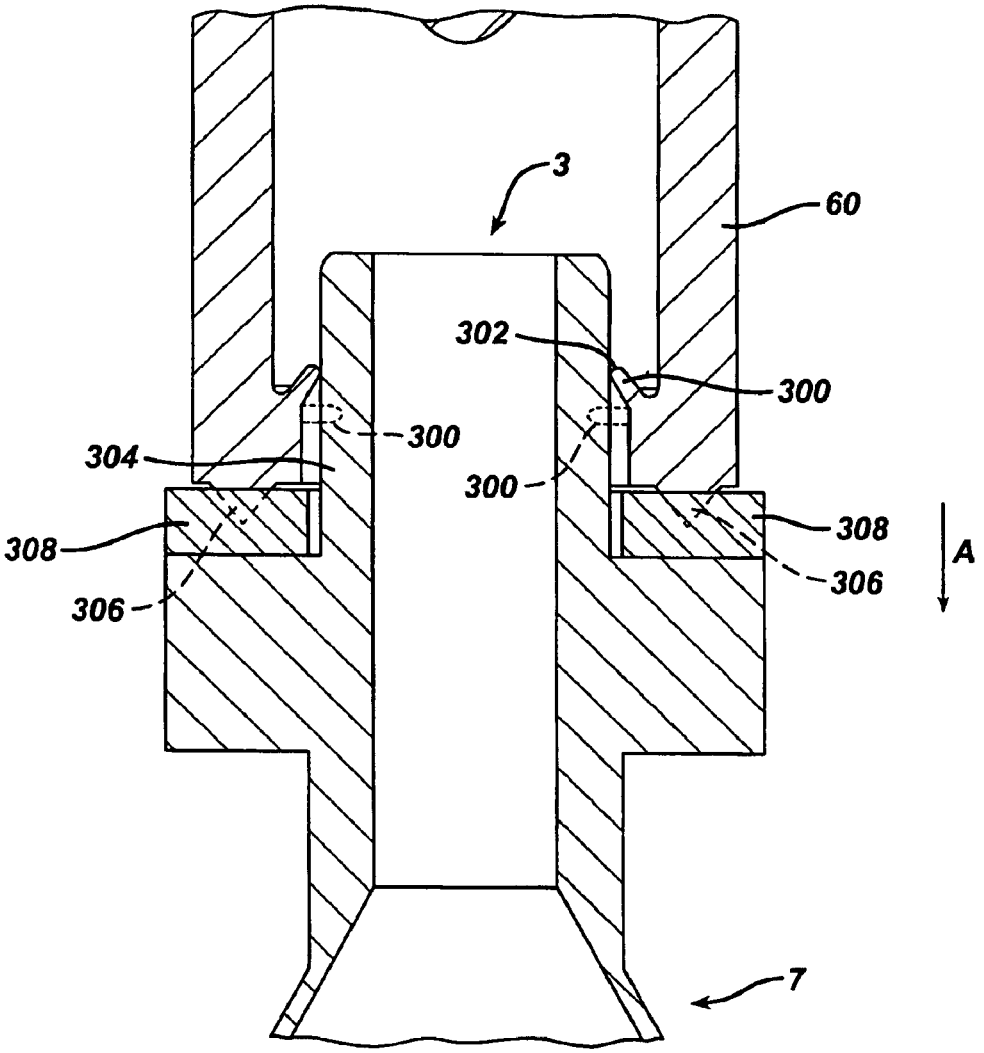
FIG. 16 is an enlarged cross-sectional view of a portion of a dispensing system.

For example, as shown in FIG. 16, the valve body 60 may include a ring-shaped finger member 300 having a sharp edge 302. If the second chamber 7 is pushed downwards (arrow A), e.g., by pressure during filling of chamber 7, the finger member will deflect as indicated by the dotted lines in FIG. 16. As a result, the ring-shaped finger member will dig into neck 304 of chamber 7 and will tend to prevent chamber 7 from being forced out of the valve body 60. Thus, increased pressure forcing the bag downwards will create an ever tighter seal between the chamber 7 and the valve body. The valve body 60 may also include barbs 306 (FIG. 16) that can be pressed into engagement with the shoulders 308 of chamber 7, to further prevent the chamber 7 from being forced out of the valve body 60.

What is claimed is:

1. A method of filling components into a pressurized dispensing system for dispensing a multi-component product, comprising (a) placing an inner, flexible container within an outer container so that open ends of the inner and outer containers are adjacent;

(b) mounting a valve assembly in sealing engagement with the open ends of the containers; and (c) delivering the components into the inner and outer containers through the valve assembly.

2. The method of claim 1 wherein the delivering step (c) comprises first delivering a component to the outer container, and then delivering a second component to the inner container.

3. The method of claim 1 wherein the delivering step (c) comprises delivering first and second components to the inner and outer containers substantially simultaneously.

4. The method of claim 1 further comprising charging a propellant to the dispensing system.

5. The method of claim 1 or 4 further comprising, prior to step (c), evacuating the inner and outer containers.

6. The method of claim 2, wherein delivering step (c) comprises:

sealing said inner container;

filling a first component into said outer container;

sealing said outer container, containing said first component;

opening said inner container; and filling said inner container with a second component.

7. The method of claim 6 further comprising using a first filling head to seal the inner container and fill the outer container, and a second filling head to seal the outer container and fill the inner container.

8. The method of claim 1 wherein the valve assembly includes a female valve stem having a first valve portion for sealing against a first valve seal to seal said inner container and a second valve portion for sealing against a second valve seal to seal said outer container.

9. A method of assembling a dispensing system for dispensing a multi-component product, comprising mounting an inner container in fluid communication with a modular valve assembly;

inserting said inner container and valve assembly into an outer body;

sealingly joining a rim portion of said modular valve assembly to a rim portion of said outer body;

forming a sealed canister comprising said outer body and said valve assembly; and pressurizing said sealed canister by filling the inner container and outer body through the modular valve assembly.

10. The method of claim 9 further comprising, prior to forming said sealed canister, positioning a piston in sealing slidable engagement with an inner wall of said outer body so that when said canister is pressurized said piston will be acted on by a propellant to force the product out of the canister during dispensing.

11. The method of claim 9 further comprising, after pressurizing the sealed canister, evacuating the inner container and outer body.

12. The method of claim 11 further comprising, after evacuation, filling the inner container and outer body through the modular valve assembly.

13. A method of filling components into a pressurized dispensing system for dispensing a multi-component product, comprising (a) placing an inner flexible container, and an outer flexible container within an outer rigid container so that open ends of the inner and outer flexible containers and the outer rigid container are adjacent;

(b) mounting a valve assembly in sealing engagement with the open ends of the containers; and (c) delivering the components into the inner and outer flexible containers through the valve assembly.

14. The method of claim 13 further comprising, prior to step (c), charging a propellant to the space between the outer flexible container and the outer rigid container.

15. The method of claim 14 further comprising, after charging the propellant and prior to step (c), evacuating the inner and outer flexible containers.

16. The method of claim 13 wherein delivering step (c) comprises:

sealing the inner flexible container;

filling a first component into said outer flexible container;

sealing said outer flexible container, containing said first component;

opening said inner flexible container; and filling said inner flexible container with a second component.

17. The method of claim 1 or 13 wherein the valve assembly includes a valve stem including one or more first opening(s) into said outer container, the first opening(s) having a total area of at least about 0.007 $in^2$ and one or more second opening(s) into said inner container, the second opening(s) having a total area of at least about 0.002 $in^2$.

18. The method of claim 1 or 13 wherein the valve assembly includes a female valve stem.

* * * * *